United States Patent [19]

Oura

[11] Patent Number: 4,641,741

[45] Date of Patent: Feb. 10, 1987

[54] PARTS SUPPLYING APPARATUS FOR BUTTON ASSEMBLING AND SETTING MACHINES

[75] Inventor: Hiroshi Oura, Kurobe, Japan

[73] Assignee: Nippon Notion Kogyo Co., Ltd., Tokyo, Japan

[21] Appl. No.: 657,497

[22] Filed: Oct. 4, 1984

[30] Foreign Application Priority Data

Oct. 4, 1983 [JP] Japan ..... 58-154056[U]

[51] Int. Cl.[4] ..... B65G 47/22

[52] U.S. Cl. ..... 198/493

[58] Field of Search ..... 198/493, 380, 562; 221/278

[56] References Cited

U.S. PATENT DOCUMENTS 3,298,491 1/1967 Quest et al. ..... 198/380
4,019,666 4/1977 Foults ..... 227/119
4,427,146 1/1984 Seki ..... 227/119

FOREIGN PATENT DOCUMENTS 654498 3/1979 U.S.S.R. ..... 198/493

*Primary Examiner*—Joseph E. Valenza
*Assistant Examiner*—Kyle E. Shane
*Attorney, Agent, or Firm*—Hill, Van Santen, Steadman & Simpson

[57] ABSTRACT

A parts supplying apparatus for use with a button assembling and setting machine includes a chute having a longitudinal guide track in and along which parts slide down one at a time, and a loading unit having a guide groove communicating with the guide track and a pusher disposed in the guide groove and slidably movable toward and away from a working station in the machine for feeding a part which has fallen from the guide track into the guide groove, in and along the latter to the working station. The chute has an exhaust nozzle disposed adjacent to a discharge end of the guide track and opening in such a direction that compressed air issued from the nozzle impinges against the underside of the part to force the latter to move smoothly from the guide track to the guide groove without stopping at a junction therebetween.

2 Claims, 4 Drawing Figures

PARTS SUPPLYING APPARATUS FOR BUTTON ASSEMBLING AND SETTING MACHINES

BACKGROUND OF THE INVENTION

1. Field of the Invention

The present invention relates to an apparatus for supplying parts one at a time to a working station in a working machine, such as a button assembling and setting machine.

2. Prior Art

There are known various parts supplying apparatus incorporated into an automatic button assembling and setting machine, for supplying button elements or parts one at a time to a working station in the machine. Such known apparatus generally comprise an inclined chute having a guide track in and along which the button parts fed from a parts feeder slide downwardly therealong one at a time, and a loading unit having a substantially horizontal guide groove communicating with the discharge end of the guide track, the guide groove having an open end disposed adjacent to the working station. The loading unit includes a reciprocably movable pusher for feeding the button which has fallen into the guide groove, in and along the latter through the open end to the working station. With this arrangement, in the course of gravity delivery, the button part is likely to stop at the junction between the inclined guide track and the horizontal guide groove. Thus, an accurate positioning of the button part with respect to the working station is difficult to achieve.

SUMMARY OF THE INVENTION

According to the present invention, a parts supplying apparatus for use with a button assembling and setting machine includes a chute having a longitudinal guide track, a loading unit having a guide groove extending in a base of the unit and communicating with the guide track, and an exhaust nozzle disposed in the chute adjacent to a discharge end of the guide track for ejecting compressed air therefrom. The exhaust nozzle opens in such a direction that compressed air issued from the nozzle impinges against the underside of a part to force the latter to move smoothly from the guide track into the guide groove without stopping at a junction between the guide track and the guide groove. Preferably, the nozzle opens in the same direction as the movement of the part along the guide track. The apparatus further includes a pusher disposed in the guide groove and slidably movable toward and away from a working station in the machine for feeding a part which has been received in the guide groove to the working station.

It is therefore an object of the present invention to provide an apparatus for supplying a button part to a working station in a button assembling and setting machine without causing the button part to stop at the junction between a guide track in an inclined chute and a substantially horizontal guide groove in a loading unit.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
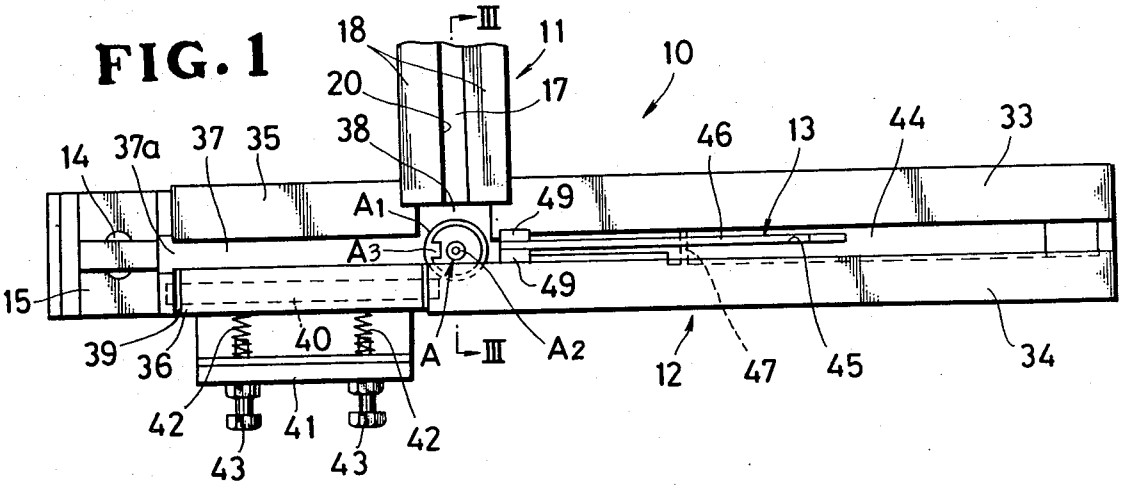
FIG. 1 is a schematic fragmentary plan view of a parts supplying apparatus according to the present invention, the apparatus being shown as incorporated into a button assembling and setting machine.
Figure 2:
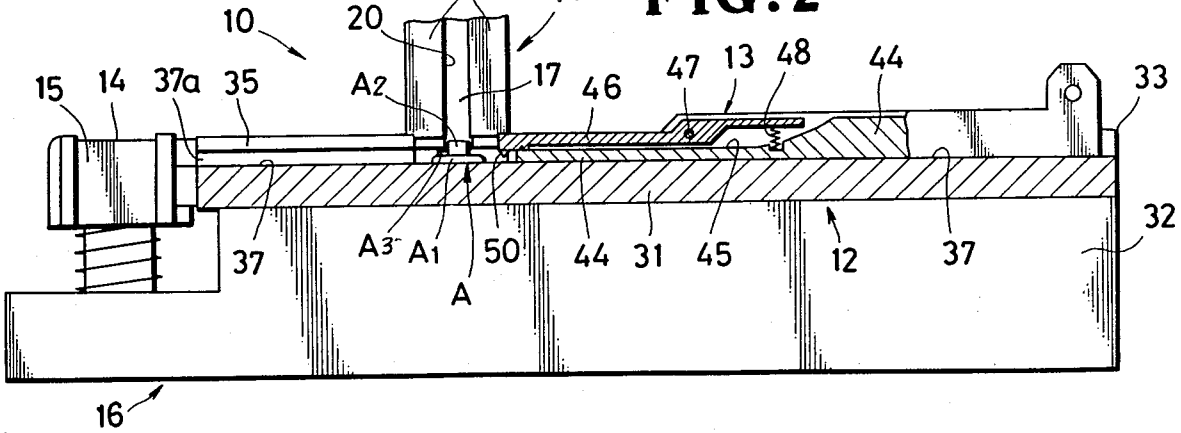
FIG. 2 is a front elevational view, partly in cross section, of the apparatus.

The principles of the present invention are particularly useful when embodied in a parts supplying apparatus such as shown in FIGS. 1 and 2, generally indicated by the numeral 10.

The apparatus 10 generally comprises an inclined chute 11 (only a lower portion being shown) connected at an upper end with a parts feeder (not shown) and at a lower end with a loading unit 12, for gravity delivery of parts A one at a time from the parts feeder therethrough to the loading unit 12. The loading unit 12 includes a feed means or pusher 13 for feeding the thus delivered part A to a working station 14. The working station 14 in the illustrated embodiment is located on a lower clinching die 15 of a button assembling and setting machine 16.

The part A comprises a button body of a button, which is adapted to be clinched with a button fastener or tack (not shown) for attachment of the body to a garment fabric such as denim. The button body A includes a circular head A1, a tubular stem A2 projecting coaxially from the head A1 for receiving therein a shank of the tack as the button is assembled, and a positioning ridge A3 projecting from the head A1 in the same direction as the stem A2. The positioning ridge A3 is used for orientating the button body A with respect to the garment fabric when the button body A has an ornamental design pattern on the head A1. The button body A is placed on the clinching die 15 with the tubular stem A2 directed upwardly.

Figure 4:
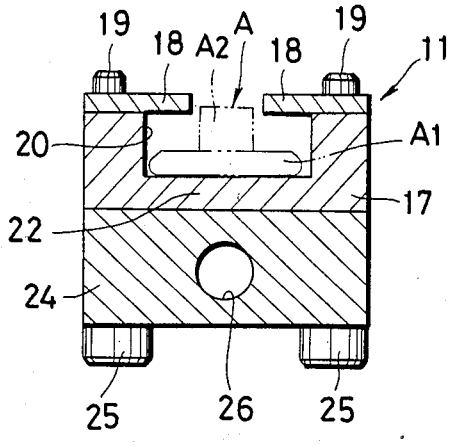
FIG. 4 is a cross-sectional view taken along line IV—IV of FIG. 3.
Figure 3:
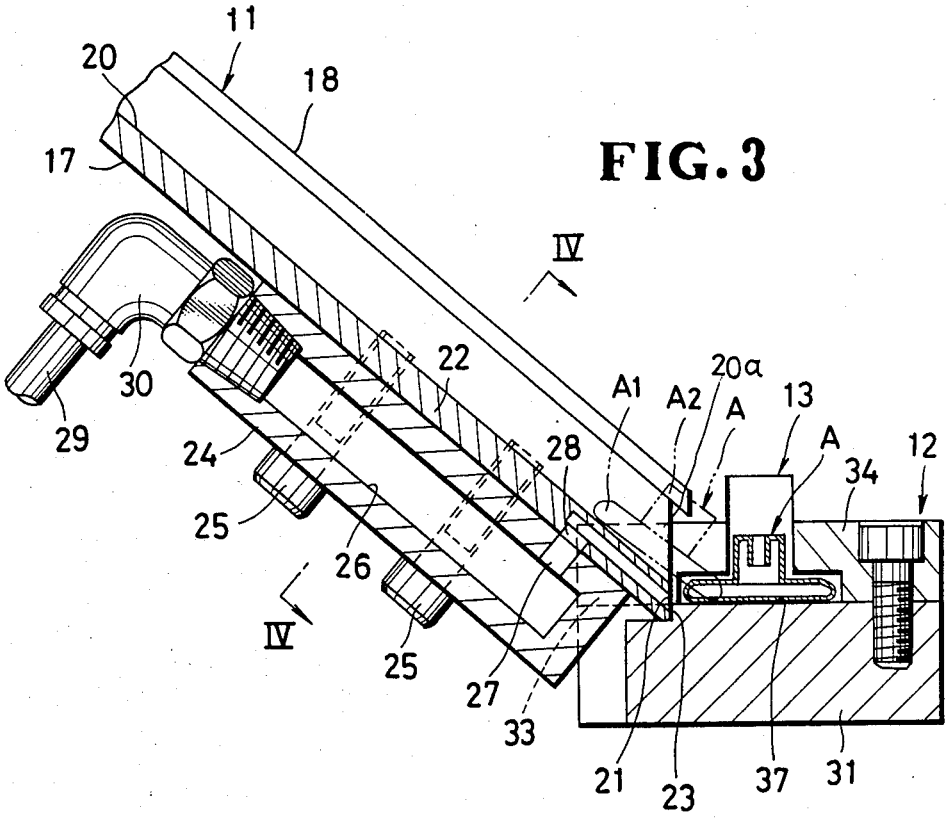
FIG. 3 is an enlarged cross-sectional view taken along line III—III of FIG. 1.

As shown in FIGS. 3 and 4, the chute 11 includes an elongate chute body 17 of generally U-shaped cross section, and a pair of parallel spaced cover plates 18, 18 disposed on an open side of the chute body 17 along the entire length thereof. The cover plates 18, 18 are laterally spaced from each other by a distance slightly larger than the outside diameter of the tubular stem A2 and they are secured to the chute body 17 by means of a plurality of screws 19. Thus, there is defined between the chute body 17 and the cover plates 18 an elongate guide track 20 for the passage therethrough of the button body A, the guide track 20 having a discharge end **20*a* (FIG. 3). The chute 11 has at least one exhaust nozzle 21 extending in a bottom wall 22 of the chute body 17 substantially in parallel relation to the guide track 20. The nozzle 21 opens at a lower discharge end 23 of the chute body 17 in a direction substantially the same as the direction of movement of the button body A along the chute 11**.

An accumulator in the shape of a hollow rectangular block 24 is secured to the underside of the chute body 17 adjacent to the discharge end 23 by means of a number of screws 25. The block 24 has a longitudinal blind hole 26 having a diameter much greater than the diameter of the nozzle 21. The blind hole 26 is held in fluid communication with the nozzle 21 through a pair passageways or holes 27, 28 formed respectively in the block 24 and the chute body 17 adjacent to the respective closed ends of the blind hole 26 and the nozzle 21. The holes 27, 28 have a common diameter which is larger than the diameter of the nozzle 21 but smaller than the diameter of the blind hole 26. The blind hole 26 is also held in fluid communication with a source of compressed air such as an air compressor (not shown) via a pipe or tubing 29 which includes an elbow 30 threaded into a threaded open end portion of the blind hole 26.

The loading unit 12 includes an elongate base 31 mounted on a support table 32 of the machine 16 (FIG. 2) with its one end held in contact with the clinching die 15. Two pairs of parallel spaced sidewalls 33, 34 and 35, 36 of inverted L-shaped cross sections (FIG. 3) are mounted on the base 31 so as to define therebetween a guide groove 37 extending longitudinally throughout the length of the base 31 for the passage of the button body A. The guide groove 37 has an open end 37*a* disposed adjacent to the working station 14.

As shown in FIG. 1, the sidewalls 33, 35 are fixed to the base 31 on one side of the guide groove 37 and are longitudinally spaced by a distance substantially equal to the maximum width of the guide track 20 in the chute 11. The chute 11 is supported on the loading unit 12 such that the discharge end 23 of the chute body 17 is disposed on the base 31 with the guide track 20 held in registry with a space 38 between the sidewalls 33, 35. Thus, the guide track 20 and the guide groove 37 communicate with each other through the space 38. The discharge end 23 and the nozzle 21 face toward the guide groove 37 as shown in FIG. 3. The sidewall 34 is fixed to the base 31 in confronting relation to the sidewall 33 across the guide groove 37 and extends beyond an inner end of the sidewall 33 by a distance substantially equal to the longitudinal extent of the space 38. The base 31 includes a recessed longitudinal portion 39 (FIG. 1) extending from the sidewall 34 toward the clinching die 15 and terminating short of the latter for receiving therein the sidewall 36. The sidewall 36 is pivotably mounted on a shaft 40 secured at opposite ends to the base 31. An L-shaped bracket 41 is secured to the base 31 and extends alongside the sidewall 36, and a pair of compression coil springs 42 is disposed between an upper portion of the sidewall 36 and a vertical arm of the bracket 41 to urge the upper portion of the sidewall 36 downwardly toward the guide groove 37. A pair of adjusting screws 43 is threaded through the vertical arm of the bracket 41 into the respective coil springs 42. With this arrangement, the entire lengths of the springs 42 and hence spring forces applied to the sidewall 36 can be adjusted in response to rotation of the adjusting screws 43.

As shown in FIGS. 1 and 2, the pusher 13 includes a pusher rod 44 slidably mounted in the guide groove 37 and movable toward and away from the clinching die 15 across a junction between the guide groove 37 and the guide track 20. The pusher rod 44 has a slot 45 extending longitudinally from one end thereof and is operatively connected at the other end with an actuator such as an air cylinder (not shown), the one end of the rod 44 facing toward the clinching die 15. A finger 46 is received in the slot 45 and is pivoted centrally on the pusher rod 44 by means of a pin 47. A compression coil spring 48 is disposed in the slot 45 and acts between the pusher rod 44 and one end of the finger 46 to urge the latter to rotate abount the pin 47 in a counterclockwise direction as viewed in FIG. 2. The finger 46 has a pair of horizontal wings 49, 49 projecting laterally in opposite directions from the other end of the finger 46, said other end of the finger 46 projecting from the one end of the pusher rod 44 toward the clinching die 15. The finger 46 includes a pair of tapered positioning projections 50 extending downwardly from the respective wings 49, 49 for receiving therebetween the positioning ridge A3 of the button body A.

In operation, the button bodies A are fed in succession from the parts feeder to the chute 11 and then slide down one at a time in and along the guide track 20 while an end portion of the stem A2 of each button body A is being guidedly received between the cover plates 18, 18. Then the button body A goes out from the discharge end 23 of the chute body 17 and immediately thereafter it impinges against the base 31 at which time the button body A tends to stop at the junction between the guide track 20 and the guide groove 37, as indicated by phantom lines in FIG. 3. However, compressed air issued from the exhaust nozzle 21 impinges against the underside of the button head A1 to force the button body A into the guide groove 37, as indicated by solid lines in FIG. 3.

Then the pusher rod 44 is actuated to move toward the clinching die 15 for feeding the button body A along the guide groove 37 through the open end 37*a* to the working station 14 and the clinching die 15. Since the sidewall 36 is spring biased toward the sidewall 35, the button head A2 is held in frictional engagement with the sidewalls 35, 36. Such frictional engagement causes the button body A to rotate about its axis in a clockwise direction as viewed in FIG. 1 until the positioning ridge A3 is received between the positioning projections 50, 50. The button body A thus locked in position between the projections 50, 50 is finally placed on the clinching die 15 with an ornamental design (not shown) on the head A1 properly orientated with respect to the garment fabric. The pusher rod 44 is then actuated to move away from the clinching die 15 to the position of FIG. 1.

The parts supplying apparatus 10 having the nozzle 21 is advantageous in that compressed air issued from the nozzle 21 impinges against the underside of the button body A to force the latter to move smoothly from the guide track 20 to the guide groove 37 without stopping at the junction therebetween. The button body A thus received in the guide groove can be placed accurately in position on the working station in the button assembling and setting machine 16.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for supplying parts one at a time to working station in a button assembling and setting machine, said apparatus comprising:

(a) a base having a substantially horizontal guide groove for the passage of the parts, said guide groove having an open end disposed adjacent to the working station;

(b) an inclined chute including an elongated chute body of a generally U-shaped cross section, said chute body having a longitudinal guide track joined transversely with said guide groove for delivering the parts one at a time into said groove, and a bottom wall defining part of said guide track, said guide track having a discharge end communicating with said guide groove, said bottom wall having a discharge end wall disposed on said base and facing toward said guide groove;

(c) means for feeding a part which has fallen into said guide groove, along the latter through said open end to the working station; and (d) an exhaust nozzle disposed in said bottom wall, extending along said guide track and opening at said discharge end wall in a direction substantially the same as the direction of movement of the part along said guide track for ejecting compressed air therefrom against the underside of the part to lift it up when the part moves across a junction between said guide track in said inclined chute and said substantially horizontal guide groove in said base, thereby letting the part move past said junction into said groove.

2. An apparatus according to claim 1, including an accumulator mounted on said chute and having a blind hole communicating with said nozzle adjacent to a closed end thereof, said blind hole having a diameter much greater than the diameter of said nozzle.

* * * * *